US010589962B2

(12) United States Patent
Watanabe

(10) Patent No.: US 10,589,962 B2
(45) Date of Patent: Mar. 17, 2020

(54) ELEVATOR HOISTING MACHINE MOUNTING DEVICE

(71) Applicant: MITSUBISHI ELECTRIC CORPORATION, Chiyoda-ku (JP)

(72) Inventor: Yasuo Watanabe, Chiyoda-ku (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 285 days.

(21) Appl. No.: 15/328,946

(22) PCT Filed: Aug. 25, 2014

(86) PCT No.: PCT/JP2014/072155
§ 371 (c)(1),
(2) Date: Jan. 25, 2017

(87) PCT Pub. No.: WO2016/030943
PCT Pub. Date: Mar. 3, 2016

(65) Prior Publication Data

US 2017/0225926 A1 Aug. 10, 2017

(51) Int. Cl.
*B66B 11/00* (2006.01)
*B66B 11/04* (2006.01)

(52) U.S. Cl.
CPC ..... *B66B 11/0035* (2013.01); *B66B 11/0045* (2013.01); *B66B 11/04* (2013.01); *B66B 11/043* (2013.01)

(58) Field of Classification Search
CPC ..... B66B 11/0035; B66B 11/004; B66B 11/0045; B66B 11/043
See application file for complete search history.

(56) References Cited

U.S. PATENT DOCUMENTS 4,286,777 A * 9/1981 Brown ..... B60G 99/004 267/294
8,939,437 B2 * 1/2015 Kobori ..... F16F 1/3735 267/140.3

(Continued)

FOREIGN PATENT DOCUMENTS

CN 1382097 A 11/2002
EP 2 067 734 A1 6/2009

(Continued)

OTHER PUBLICATIONS

Combined Office Action and Search Report dated May 21, 2018 in Chinese Patent Application No. 201480081521.2 with English translation of the Office Action and English translation of categories of cited documents, 21 pages.

(Continued)

*Primary Examiner* — Minh Truong
(74) *Attorney, Agent, or Firm* — Xsensus LLP

(57) ABSTRACT

In an elevator hoisting machine mounting device, an elastic support device includes a supporting elastic body that deforms elastically upon reception of a load from a hoisting machine unit. A buckling suppression device disposed at a remove from the elastic support device in a horizontal direction includes first and second buckling suppression elastic bodies that sandwich, from above and below, a buckling suppression attachment portion provided on a lower portion of the hoisting machine unit, and a holding tool that holds the first and second buckling suppression elastic bodies on a machine base. The buckling suppression device suppresses, by an elastic restoring force of the first and second buckling suppression elastic bodies, buckling of the hoisting machine unit relative to the machine base due to the elastic deformation of the supporting elastic body.

8 Claims, 13 Drawing Sheets

(56) References Cited

U.S. PATENT DOCUMENTS

| | | | | |
|---|---|---|---|---|
| 2003/0155480 | A1* | 8/2003 | Cholinski | B66B 11/004 248/646 |
| 2004/0104079 | A1* | 6/2004 | Fischer | B66B 7/021 187/254 |
| 2011/0132695 | A1* | 6/2011 | Aziz | B66B 11/0045 187/266 |

FOREIGN PATENT DOCUMENTS

| | | | |
|---|---|---|---|
| EP | 2 724 971 | A1 | 4/2014 |
| JP | 52-32869 | U1 | 3/1977 |
| JP | 52-121056 | U1 | 9/1977 |
| JP | 52-121056 | A | 10/1977 |
| JP | 2002-154758 | A | 5/2002 |
| JP | 2007-284153 | A | 11/2007 |
| WO | WO 01/89975 | A1 | 11/2001 |
| WO | 2008/041266 | A1 | 4/2008 |
| WO | 2012/176287 | A1 | 12/2012 |

OTHER PUBLICATIONS

International Search Report dated Nov. 11, 2014 in PCT/JP2014/072155 filed Aug. 25, 2014.
Examination Report issued in Indian Application 201747001913 dated Nov. 14, 2019.

* cited by examiner

ELEVATOR HOISTING MACHINE MOUNTING DEVICE

TECHNICAL FIELD

This invention relates to an elevator hoisting machine mounting device for mounting an elevator hoisting machine on a machine base.

BACKGROUND ART

In a conventional elevator, a frame body is attached between upper end portions of a pair of guide rails such that an upper portion of a hoisting machine is supported by an upper portion of the frame body via an elastic body and a lower portion of the hoisting machine is supported by a lower portion of the frame body via an elastic body (see PTL 1).

In another conventional elevator, a lower portion support and an upper portion support disposed above the lower portion support are attached to an upper portion of a guide rail, a hoisting machine is disposed between the lower portion support and the upper portion support, and oscillation-damping rubber is interposed respectively between the hoisting machine and the lower portion and upper portion supports (see PTL 2).

In a further conventional elevator, a support beam is fixed between upper end portions of a pair of guide rails, and a hoisting machine is supported by the support beam via a first elastic body and a second elastic body having different spring constants. The first and second elastic bodies are disposed at a remove from each other in a horizontal direction (see PTL 3).

CITATION LIST

Patent Literature

[PTL 1] WO 2008/041266

[PTL 2] Japanese Patent Application Publication No. 2002-154758

[PTL 3] Japanese Patent Application Publication No. 2007-284153

SUMMARY OF INVENTION

Technical Problem

However, in the conventional elevators disclosed in PTL 1 and 2, the upper portion and lower portion of the hoisting machine are supported by the frame body or the supports via elastic bodies, and therefore a space for performing maintenance and inspection operations on the hoisting machine is small, making it difficult to perform maintenance and inspection operations on the hoisting machine.

Further, in the conventional elevator disclosed in PTL 3, in consideration of an increase in oscillation in the hoisting machine during an earthquake or the like, for example, it is necessary to stabilize a support structure of the hoisting machine by increasing a distance between the first elastic body and the second elastic body. As a result, a space occupied in the horizontal direction by the support beam supporting the hoisting machine increases.

This invention has been designed to solve the problems described above, and an object thereof is to obtain an elevator hoisting machine mounting device with which maintenance and inspection operations can be performed on a hoisting machine easily, and an amount of space required to mount the hoisting machine mounting device can be reduced.

Solution to Problem

An elevator hoisting machine mounting device according to this invention includes an elastic support device provided on a machine base, a hoisting machine unit having a hoisting machine that generates driving force for moving an elevating body being placed on the elastic support device, and a buckling suppression device disposed at a remove from the elastic support device in a horizontal direction, wherein the elastic support device includes a supporting elastic body that deforms elastically upon reception of a load from the hoisting machine unit, and the buckling suppression device includes first and second buckling suppression elastic bodies that sandwich, from above and below, a buckling suppression attachment portion provided on a lower portion of the hoisting machine unit, and a holding tool that holds the first and second buckling suppression elastic bodies on the machine base, whereby buckling of the hoisting machine unit relative to the machine base due to the elastic deformation of the supporting elastic body is suppressed by an elastic restoring force of the first and second buckling suppression elastic bodies.

Advantageous Effects of Invention

With the elevator hoisting machine mounting device according to this invention, buckling of the hoisting machine unit relative to the machine base can be suppressed effectively by the buckling suppression device. As a result, the buckling suppression device can be disposed closer to the elastic support device in the horizontal direction, enabling a reduction in the amount of space required to mount the hoisting machine mounting device. Furthermore, a space above the hoisting machine unit can be left open, and therefore maintenance and inspection operations can be performed on the hoisting machine unit easily.

DESCRIPTION OF EMBODIMENTS

Preferred embodiments of this invention will be described below with reference to the drawings.

First Embodiment

Figure 1:
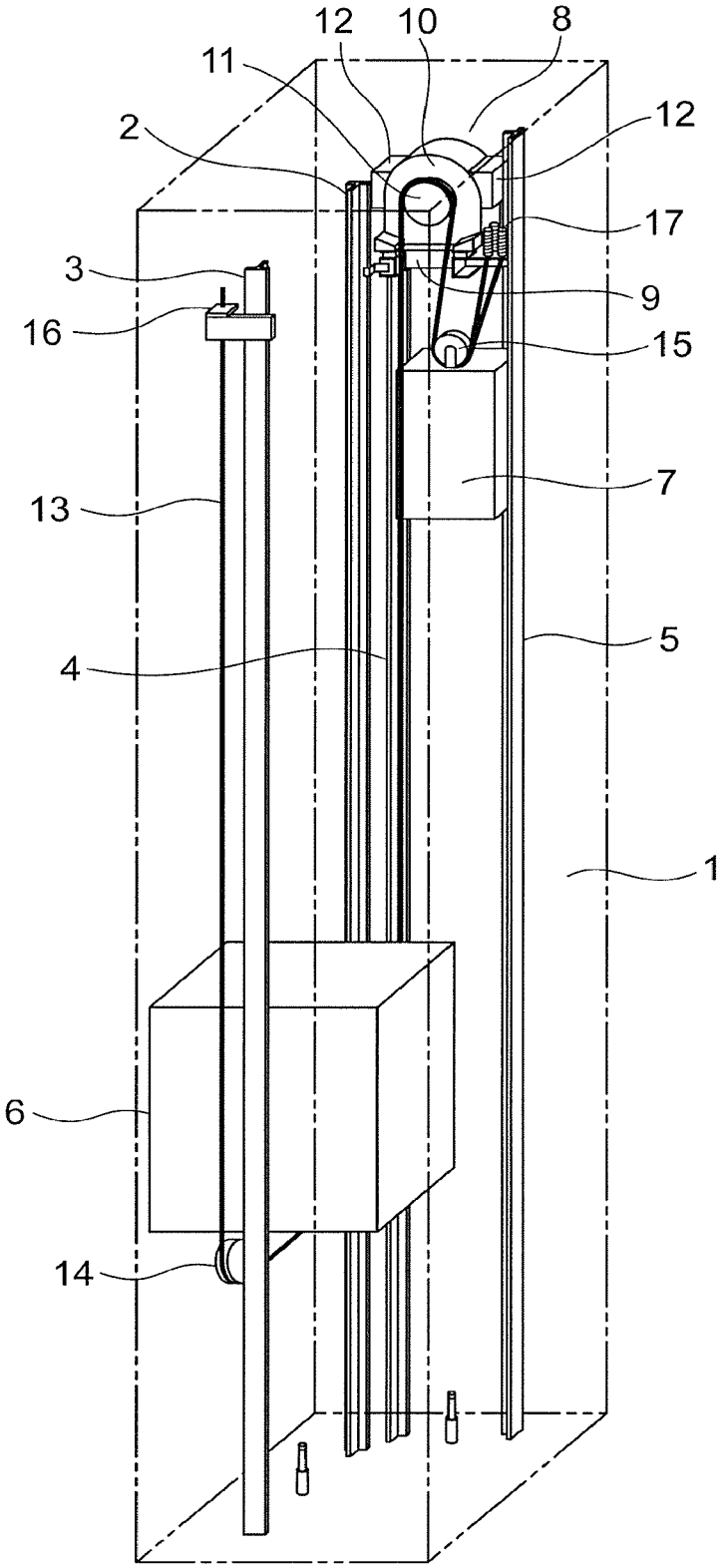
FIG. 1 is a view showing a configuration of an elevator according to a first embodiment of this invention.

FIG. 1 is a view showing a configuration of an elevator according to a first embodiment of this invention. In the drawing, a pair of car guide rails 2, 3 and a pair of counter weight guide rails 4, 5 are respectively mounted vertically within a hoistway 1. The pair of car guide rails 2, 3 are disposed at a remove from each other in a horizontal direction, and the pair of counterweight guide rails 4, 5 are likewise disposed at a remove from each other in the horizontal direction. Respective lower end portions of the car guide rails 2, 3 and the counter weight guide rails 4, 5 are fixed to a bottom surface of the hoistway 1.

In this example, the pair of car guide rails 2, 3 exist on one of two mutually orthogonal imaginary vertical planes, and the pair of counter weight guide rails 4, 5 exist on the other imaginary vertical plane. Further, in this example, the car guide rail 2, of the pair of car guide rails 2, 3, is disposed closer to the pair of counter weight guide rails 4, 5 than the car guide rail 3. Furthermore, in this example, the counter weight guide rail 4, of the pair of counter weight guide rails 4, 5, is disposed closer to the car guide rail 2 than the counter weight guide rail 5. Moreover, in this example, the car guide rails 2, 3 are solid steel rails, while the counter weight guide rails 4, 5 are forming rails molded by subjecting steel plate to plastic deformation.

A car 6 serving as an elevating body exists between the pair of car guide rails 2, 3, and a counter weight 7 serving as an elevating body exists between the pair of counter weight guide rails 4, 5. The car 6 is capable of moving in a vertical direction while being guided by the pair of car guide rails 2, 3. The counter weight 7 is capable of moving in the vertical direction while being guided by the pair of counter weight guide rails 4, 5.

A hoisting machine unit including a hoisting machine 8 that generates driving force for moving the car 6 and the counter weight 7 is disposed in an upper portion of the hoistway 1. In this example, the hoisting machine unit is constituted by the hoisting machine 8 alone. The hoisting machine 8 is supported by a common machine base 9. The machine base 9 is attached respectively to the car guide rail 2 and the counter weight guide rails 4, 5. As a result, a load from the machine base 9 is divided among, and thus supported by, the car guide rail 2 and the counter weight guide rails 4, 5.

The hoisting machine 8 includes a hoisting machine main body 10 including a motor, a drive sheave 11 provided in the hoisting machine main body 10 so as to be rotated by driving force from the hoisting machine main body 10, and a brake device 12 provided in the hoisting machine main body 10 so as to apply a brake to the rotation of the drive sheave 11. The hoisting machine 8 is disposed such that an axis of the drive sheave 11 is horizontal. In this example, the hoisting machine 8 is a low-profile hoisting machine. In other words, in this example, a radial direction dimension of the hoisting machine 8 is larger than an axial direction dimension of the hoisting machine 8.

The car 6 and the counter weight 7 are suspended within the hoistway 1 by a plurality of ropes 13 serving as suspending bodies. Belts may also be used as the suspending bodies from which the car 6 and the counter weight 7 are suspended. A pair of car suspension sheaves 14 are provided on a lower portion of the car 6, and a counter weight suspension sheave 15 is provided on an upper portion of the counter weight 7. A first rope fixing device 16 is provided on an upper end portion of the car guide rail 3, and a second rope fixing device 17 is provided on the machine base 9. One end portion of each rope 13 is connected to the first rope fixing device 16, and another end portion of each rope 13 is connected to the second rope fixing device 17. Each rope 13 extends from the first rope fixing device 16 to the second rope fixing device 17, and is wound around the pair of car suspension sheaves 14, the drive sheave 11, and the counter weight suspension sheave 15, in that order. In other words, a 2:1 roping method is used as a method of suspending the car 6 and the counter weight 7 from the ropes 13.

Loads from the car 6 and the counter weight 7 are exerted downward on the drive sheave 11 via the ropes 13. The car 6 and the counter weight 7 are moved through the hoistway 1 in the vertical direction in accordance with the rotation of the drive sheave 11.

Figure 2:
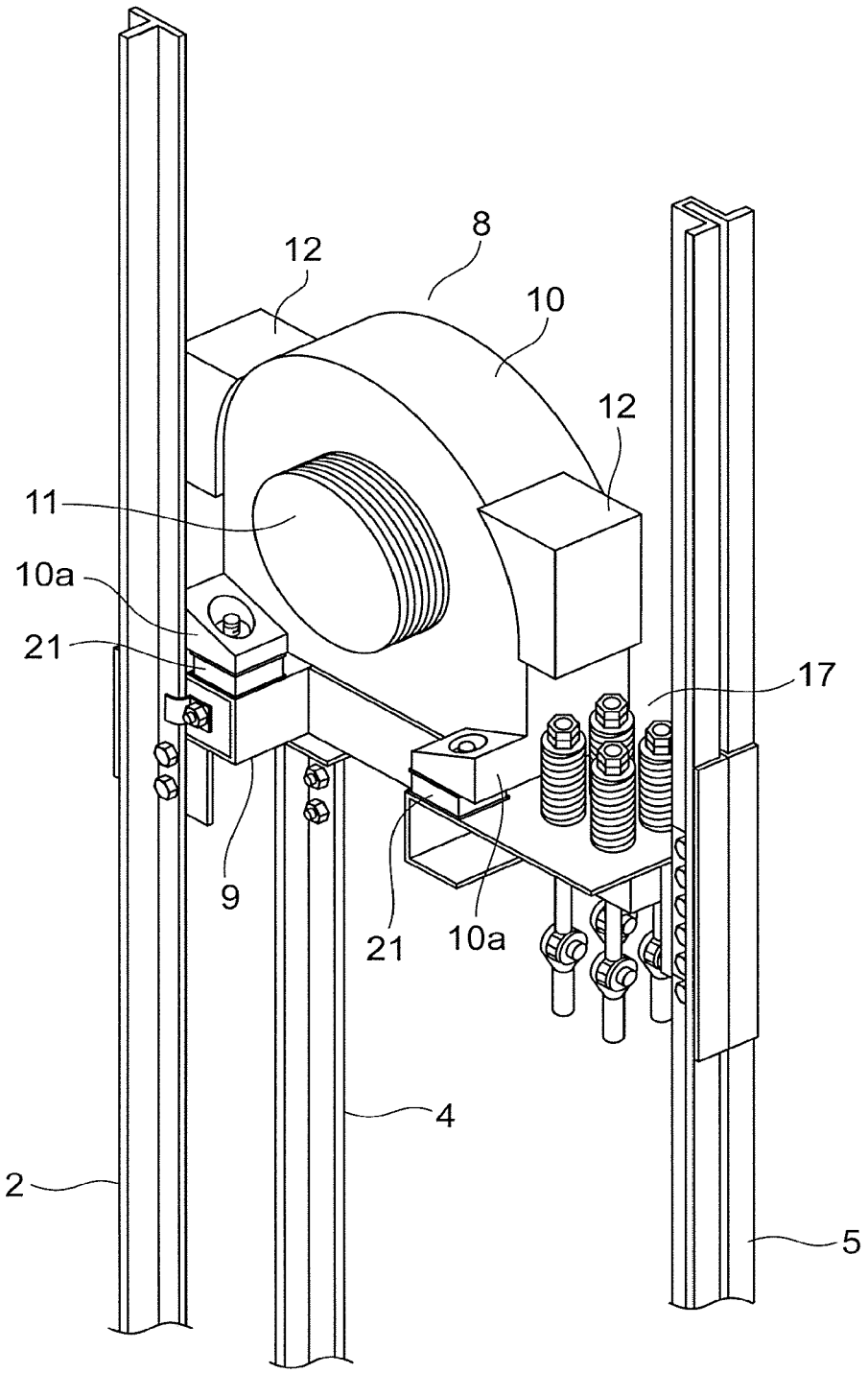
FIG. 2 is a perspective view of a hoisting machine shown in FIG. 1.
Figure 3:
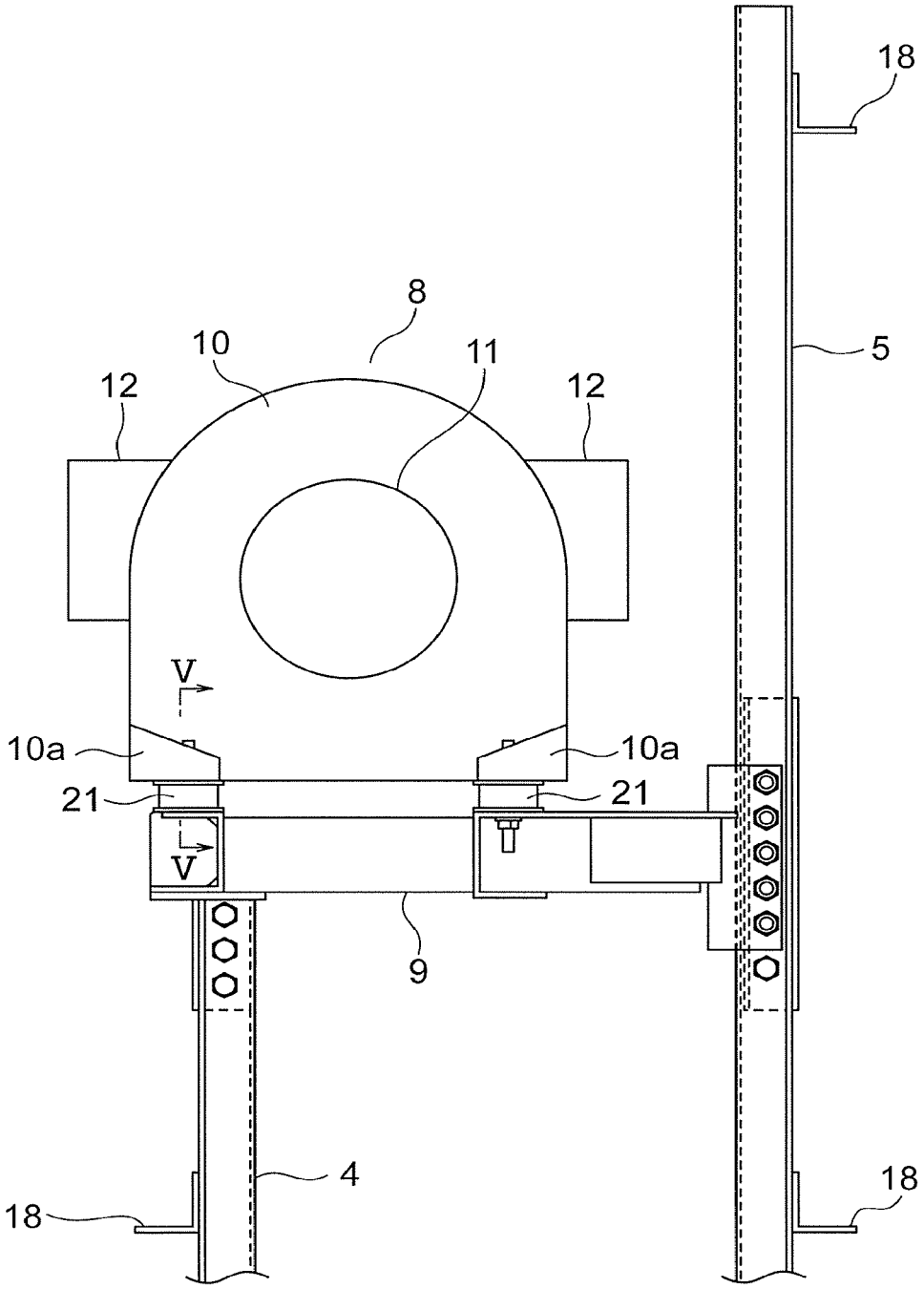
FIG. 3 is a front view of the hoisting machine shown in FIG. 2.
Figure 4:
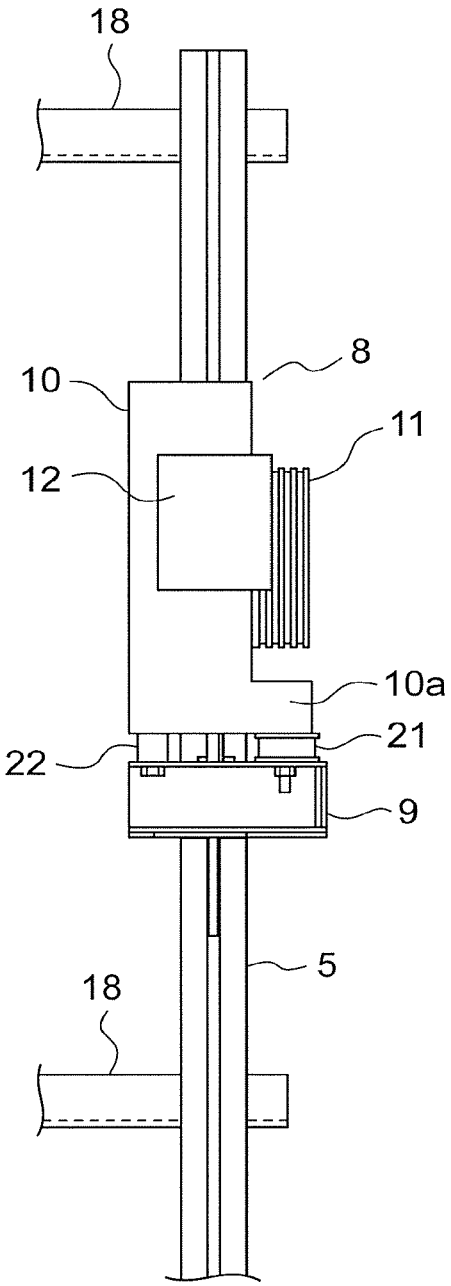
FIG. 4 is a side view of the hoisting machine shown in FIG. 2.
Figure 5:
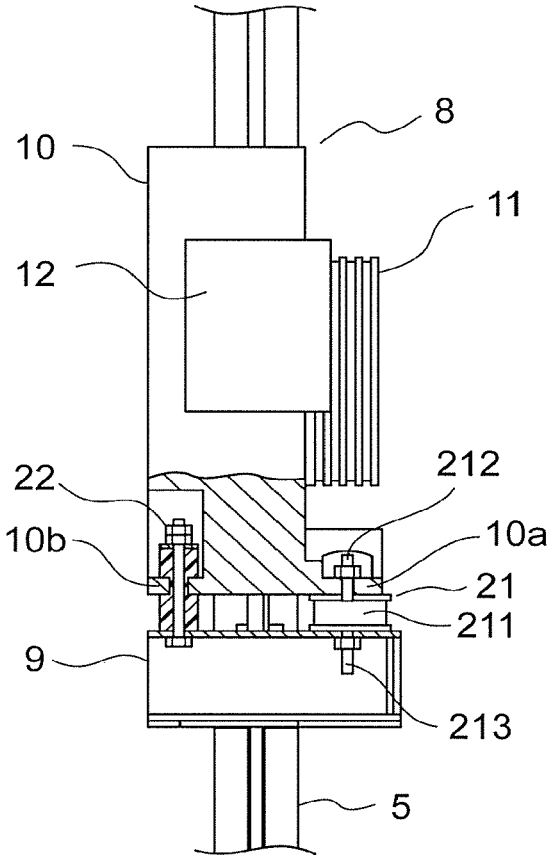
FIG. 5 is a side view of the hoisting machine, including a partial cross-section taken along a V-V line in FIG. 3.

FIG. 2 is a perspective view showing the hoisting machine 8 of FIG. 1. Further, FIG. 3 is a front view of the hoisting machine 8 shown in FIG. 2, and FIG. 4 is a side view of the hoisting machine 8 shown in FIG. 2. Furthermore, FIG. 5 is a side view of the hoisting machine 8, including a partial cross-section taken along a V-V line in FIG. 3. As shown in FIGS. 3 and 4, the car guide rails 2, 3 and the counter weight guide rails 4, 5 are attached to a plurality of brackets 18 fixed to an inner wall surface of the hoistway 1. Further, a position of an upper end portion of the counter weight guide rail 4 is set to be lower than positions of respective upper end portions of the car guide rails 2, 3 and the counter weight guide rail 5. The machine base 9 is placed on the counter weight guide rail 4, and in this condition attached respectively to the car guide rail 2 and the counter weight guide rails 4, 5.

A pair of horizontally projecting hoisting machine front leg portions 10*a* are provided on an axial direction front end portion of a lower portion of the hoisting machine main body 10 as a pair of supporting attachment portions. The pair of hoisting machine front leg portions 10*a* are disposed at a remove from each other in the horizontal direction when the hoisting machine 8 is seen in the axial direction of the drive sheave 11. In this example, as shown in FIG. 3, the hoisting machine front leg portions 10*a* are disposed respectively on left and right end portions of the hoisting machine main body 10 when the hoisting machine 8 is seen in the axial direction of the drive sheave 11.

As shown in FIG. 5, a pair of horizontally projecting hoisting machine back leg portions 10*b* are provided on an axial direction rear end portion of the lower portion of the hoisting machine main body 10 as a pair of buckling suppression attachment portions. The pair of hoisting machine back leg portions 10*b* are disposed at a remove from each other in the horizontal direction when the hoisting machine 8 is seen in the axial direction of the drive sheave 11. In this example, the hoisting machine back leg portions 10*b* are disposed respectively on the left and right end portions of the hoisting machine main body 10 when the hoisting machine 8 is seen in the axial direction of the drive sheave 11.

A pair of elastic support devices 21 on which the pair of hoisting machine front leg portions 10*a* are placed individually, and a pair of buckling suppression devices 22 which are attached individually to the pair of hoisting machine back leg portions 10*b*, are provided on the machine base 9. The buckling suppression devices 22 are disposed at a remove from the elastic support devices 21 in the horizontal direction. Note that a hoisting machine mounting device for mounting the hoisting machine 8 on the machine base 9 includes the elastic support devices 21 and the buckling suppression devices 22.

The elastic support devices 21 are disposed closer to the drive sheave 11 than the buckling suppression devices 22 in the axial direction of the drive sheave 11. In this example, respective positions of the elastic support devices 21 are aligned with the position of the drive sheave 11 in the axial direction of the drive sheave 11. In other words, in this example, the elastic support devices 21 are disposed directly below the drive sheave 11 when the hoisting machine 8 is seen from the side (i.e. when the hoisting machine 8 is seen along a horizontal line that is perpendicular to the axis of the drive sheave 11).

Further, as shown in FIG. 3, the pair of elastic support devices 21 are disposed at a remove from each other in the horizontal direction when the hoisting machine 8 is seen in the axial direction of the drive sheave 11. Furthermore, the pair of elastic support devices 21 are disposed respectively on left and right sides of a vertical line passing through the axis of the drive sheave 11 when the hoisting machine 8 is seen in the axial direction of the drive sheave 11.

As shown in FIG. 5, each elastic support device 21 includes a supporting rubber member 211 serving as a supporting elastic body interposed between a lower surface of the hoisting machine front leg portion 10*a* provided on the hoisting machine main body 10 and an upper surface of the machine base 9, an upper portion projecting bolt 212 that projects upward from the supporting rubber member 211 and penetrates the hoisting machine front leg portion 10*a* so as to be capable of sliding through the hoisting machine front leg portion 10*a* in the vertical direction, and a lower portion projecting bolt 213 that projects downward from the supporting rubber member 211 and penetrates a support plate portion forming the upper surface of the machine base 9 so as to be capable of sliding through the support plate portion in the vertical direction.

A nut is attached to the upper portion projecting bolt 212 to prevent the upper portion projecting bolt 212 from becoming detached from the hoisting machine front leg portion 10*a*. A nut is attached to the lower portion projecting bolt 213 to prevent the lower portion projecting bolt 213 from becoming detached from the upper portion of the machine base 9.

The supporting rubber member 211 deforms elastically upon reception of a load serving as a compressive force from the hoisting machine 8. Oscillation of the hoisting machine 8 is absorbed by the elastic deformation of the supporting rubber member 211. However, when an external force is exerted on the hoisting machine 8 due to swaying of a building caused by an earthquake or a strong wind, a braking operation of a safety device provided in the car 6, or the like, for example, the hoisting machine 8 may buckle relative to the machine base 9 due to the elastic deformation of the supporting rubber member 211. The buckling suppression devices 22 suppress buckling of the hoisting machine 8 relative to the machine base 9 when the supporting rubber members 211 deform elastically.

The buckling suppression devices 22 are disposed further away from the drive sheave 11 than the elastic support devices 21 in the axial direction of the drive sheave 11. Further, the pair of buckling suppression devices 22 are disposed at a remove from each other in the horizontal direction when the hoisting machine 8 is seen in the axial direction of the drive sheave 11. Furthermore, the pair of buckling suppression devices 22 are disposed respectively on the left and right sides of a vertical line passing through the axis of the drive sheave 11 when the hoisting machine 8 is seen in the axial direction of the drive sheave 11.

Figure 6:
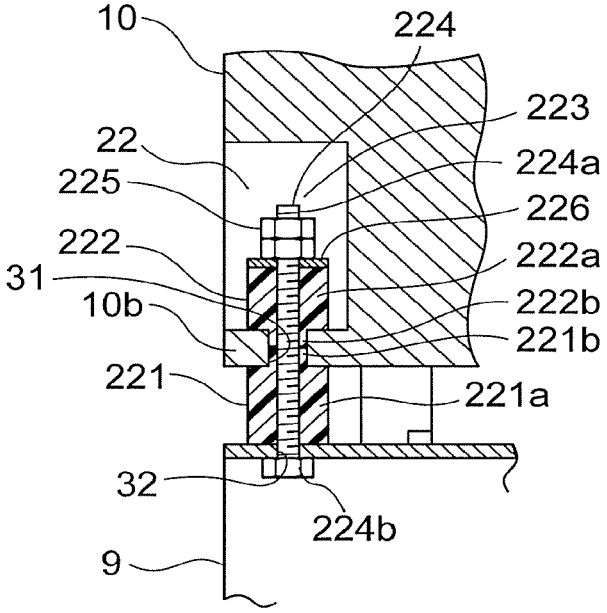
FIG. 6 is an enlarged sectional view of a buckling suppression device shown in FIG. 5.

FIG. 6 is an enlarged sectional view of the buckling suppression device 22 shown in FIG. 5. A through hole 31 is provided in the hoisting machine back leg portion 10*b* of the hoisting machine main body 10 so as to extend in the vertical direction. The machine base 9 includes the support plate portion forming the upper surface of the machine base 9. A through hole 32 is provided in the vertical direction in the support plate portion of the machine base 9. In this example, an inner diameter of the through hole 31 provided in the hoisting machine back leg portion 10*b* is set to be larger than an inner diameter of the through hole 32 provided in the support plate portion of the machine base 9.

Each buckling suppression device 22 includes first and second buckling suppression rubber members 221, 222 serving as first and second buckling suppression elastic bodies that sandwich the hoisting machine back leg portion 10*b* from above and below, and a holding tool 223 that holds the first and second buckling suppression rubber members 221, 222 on the machine base 9. In this example, the first buckling suppression rubber member 221 is disposed on a lower side of the hoisting machine back leg portion 10*b*, and the second buckling suppression rubber member 222 is disposed on an upper side of the hoisting machine back leg portion 10*b*.

The first buckling suppression rubber member 221 includes a main body portion 221*a* that contacts a lower surface of the hoisting machine back leg portion 10*b*, and an insertion portion 221*b* that is inserted into the through hole 31 from the main body portion 221*a*. The second buckling suppression rubber member 222 includes a main body portion 222*a* that contacts an upper surface of the hoisting machine back leg portion 10*b*, and an insertion portion 222*b* that is inserted into the through hole 31 from the main body portion 222*a*. The first and second buckling suppression rubber members 221, 222 sandwich the hoisting machine back leg portion 10*b* from above and below in a condition where the respective insertion portions 221*b*, 222*b* thereof contact each other within the through hole 31. The main body portion 221*a* of the first buckling suppression rubber member 221 is sandwiched between the lower surface of the hoisting machine back leg portion 10*b* and the upper surface of the machine base 9. In this example, a spring constant of the first buckling suppression rubber member 221 is set to be identical to a spring constant of the second buckling suppression rubber member 222.

The holding tool 223 includes a through bolt 224 serving as a rod-shaped body that projects from the machine base 9 so as to penetrate the hoisting machine back leg portion 10*b* and the first and second buckling suppression rubber members 221, 222, and a nut 225 provided on the through bolt 224 as a fixing member such that the hoisting machine back leg portion 10*b* and the first and second buckling suppression rubber members 221, 222 are sandwiched together between the nut 225 and the machine base 9. A washer 226 having a larger outer diameter than the nut 225 is interposed between an upper surface of the second buckling suppression rubber member 222 and the nut 225.

The through bolt 224 includes a screw shaft portion 224*a*, and a head portion 224*b* provided on an end portion of the screw shaft portion 224*a*. Further, the through bolt 224 is provided on the machine base 9 such that the screw shaft portion 224*a* passes through the through hole 32 of the machine base 9 and the through hole 31 of the hoisting machine back leg portion 10*b*, and the head portion 224*b* catches on a lower surface of the support plate portion of the machine base 9. Thus, the through bolt 224 functions as a stopper that suppresses horizontal direction displacement of the hoisting machine 8 and the first and second buckling suppression rubber members 221, 222 relative to the machine base 9.

The screw shaft portion 224*a* of the through bolt 224 passes through the through holes 31, 32 so as to penetrate the first and second buckling suppression rubber members 221, 222. The through bolt 224 can be displaced relative to the first and second buckling suppression rubber members 221, 222 in a lengthwise direction of the screw shaft portion 224*a*.

The nut 225 is attached to a part of the screw shaft portion 224*a* of the through bolt 224 that projects from the upper surface of the second buckling suppression rubber member 222. By rotating the nut 225 relative to the screw shaft portion 224*a* so that the nut 225 is fastened thereto, the first and second buckling suppression rubber members 221, 222 are restrained together with the support plate portion of the machine base 9 between the head portion 224*b* of the through bolt 224 and the nut 225. The holding tool 223 holds the first and second buckling suppression rubber members 221, 222 on the machine base 9 by restraining the first and second buckling suppression rubber members 221, 222 together with the support plate portion of the machine base 9 using the through bolt 224 and the nut 225.

When an external force from an earthquake or the like, for example, is exerted on the hoisting machine 8 in a direction for causing the hoisting machine 8 to buckle, the supporting rubber member 211 deforms elastically, causing the hoisting machine 8 to oscillate relative to the machine base 9 using the elastic support device 21 as a fulcrum in a direction for displacing the hoisting machine back leg portion 10*b* upward and downward relative to the machine base 9. At this time, oscillation of the hoisting machine 8 in a direction for displacing the hoisting machine back leg portion 10*b* upward is suppressed by an elastic restoring force of the second buckling suppression rubber member 222, and oscillation of the hoisting machine 8 in a direction for displacing the hoisting machine back leg portion 10*b* downward is suppressed by an elastic restoring force of the first buckling suppression rubber member 221. In other words, buckling of the hoisting machine 8 relative to the machine base 9 due to elastic deformation of the supporting rubber member 211 is suppressed by the elastic restoring force of the first and second buckling suppression rubber members 221, 222.

In this elevator hoisting machine mounting device, the hoisting machine back leg portion 10*b* provided on the lower portion of the hoisting machine 8 is sandwiched from above and below by the first and second buckling suppression rubber members 221, 222 such that buckling of the hoisting machine 8 relative to the machine base 9 due to elastic deformation of the supporting rubber member 211 of the elastic support device 21 is suppressed by the elastic restoring force of the first and second buckling suppression rubber members 221, 222, and therefore buckling of the hoisting machine 8 relative to the machine base 9 can be suppressed effectively by the buckling suppression device 22. Accordingly, an oscillation suppression effect can be secured reliably in the hoisting machine 8 even when the buckling suppression device 22 is close to the elastic support device 21 in the horizontal direction, and as a result, an amount of space required to mount the hoisting machine mounting device can be reduced. Moreover, there is no need to mount a device for suppressing oscillation of the hoisting machine 8 above the hoisting machine 8, and therefore a space above the hoisting machine 8 can be left open. As a result, a space for performing maintenance and inspection operations (a maintenance operation on the brake device 12 or the like, for example) on the hoisting machine 8 can be secured such that maintenance and inspection operations can be performed on the hoisting machine 8 more easily.

Further, the holding tool 223 includes the through bolt 224 that penetrates the hoisting machine back leg portion 10*b* and the first and second buckling suppression rubber members 221, 222, and the nut 225 that sandwiches the hoisting machine back leg portion 10*b* and the first and second buckling suppression rubber members 221, 222 together between itself and the machine base 9, and therefore the first and second buckling suppression rubber members 221, 222 can be held on the machine base 9 by means of a simple configuration. Moreover, the through bolt 224 can be used as a stopper that prevents horizontal direction displacement of the hoisting machine 8 relative to the machine base 9, and therefore the condition in which the hoisting machine 8 is attached to the machine base 9 can be stabilized.

Furthermore, the respective buckling suppression devices 22 are disposed at a remove from each other when seen in the axial direction of the drive sheave 11, and therefore buckling of the hoisting machine 8 can be suppressed even more reliably.

Second Embodiment

Figure 7:
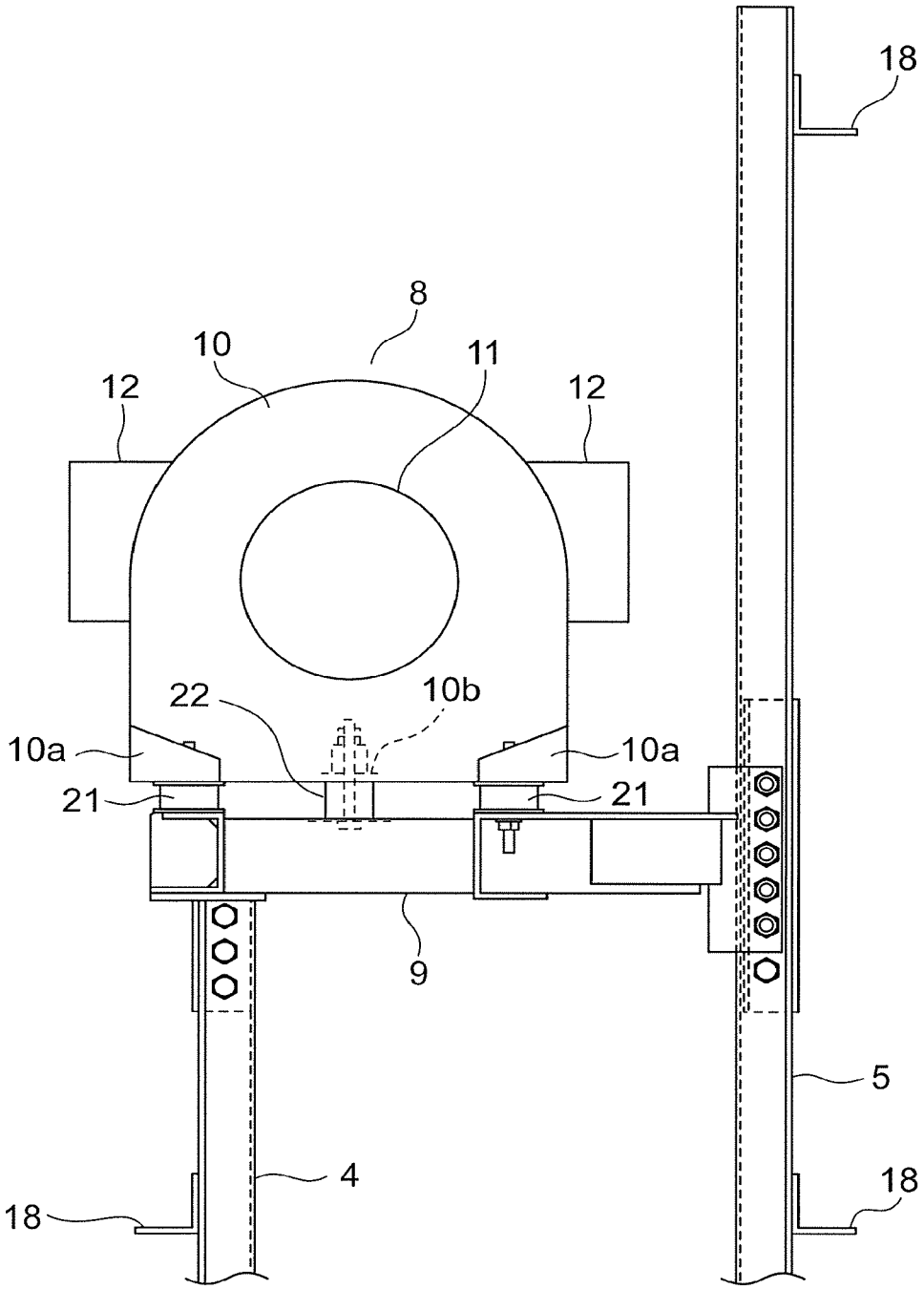
FIG. 7 is a front view showing a condition in which an elevator hoisting machine is mounted on a machine base, according to a second embodiment of this invention.

FIG. 7 is a front view showing a condition in which an elevator hoisting machine is mounted on a machine base, according to a second embodiment of this invention. In this embodiment, the buckling suppression device 22 is provided singly on the machine base 9. Further, the hoisting machine back leg portion 10*b* serving as the buckling suppression attachment portion is provided singly on the axial direction rear end portion of the lower portion of the hoisting machine main body 10. In this embodiment, the respective positions of the single hoisting machine back leg portion 10*b* and the single buckling suppression device 22 are modified, while all other configurations are identical to the first embodiment.

The hoisting machine back leg portion 10*b* is disposed between the pair of hoisting machine front leg portions 10*a* when the hoisting machine 8 is seen in the axial direction of the drive sheave 11. The buckling suppression device 22 is attached to the hoisting machine back leg portion 10*b* and provided thus on the machine base 9.

The buckling suppression device 22 is disposed further away from the drive sheave 11 than the respective elastic support devices 21 in the axial direction of the drive sheave 11. Further, the buckling suppression device 22 is disposed between the pair of elastic support devices 21 when the hoisting machine 8 is seen in the axial direction of the drive sheave 11. In this example, the buckling suppression device 22 is disposed on a vertical line passing through the axis of the drive sheave 11 when the hoisting machine 8 is seen in the axial direction of the drive sheave 11.

By disposing the buckling suppression device 22 between the pair of elastic support devices 21 when the hoisting machine 8 is seen in the axial direction of the drive sheave 11 in this manner, the number of buckling suppression devices 22 can be reduced, and as a result, a cost reduction can be achieved.

Third Embodiment

Figure 8:
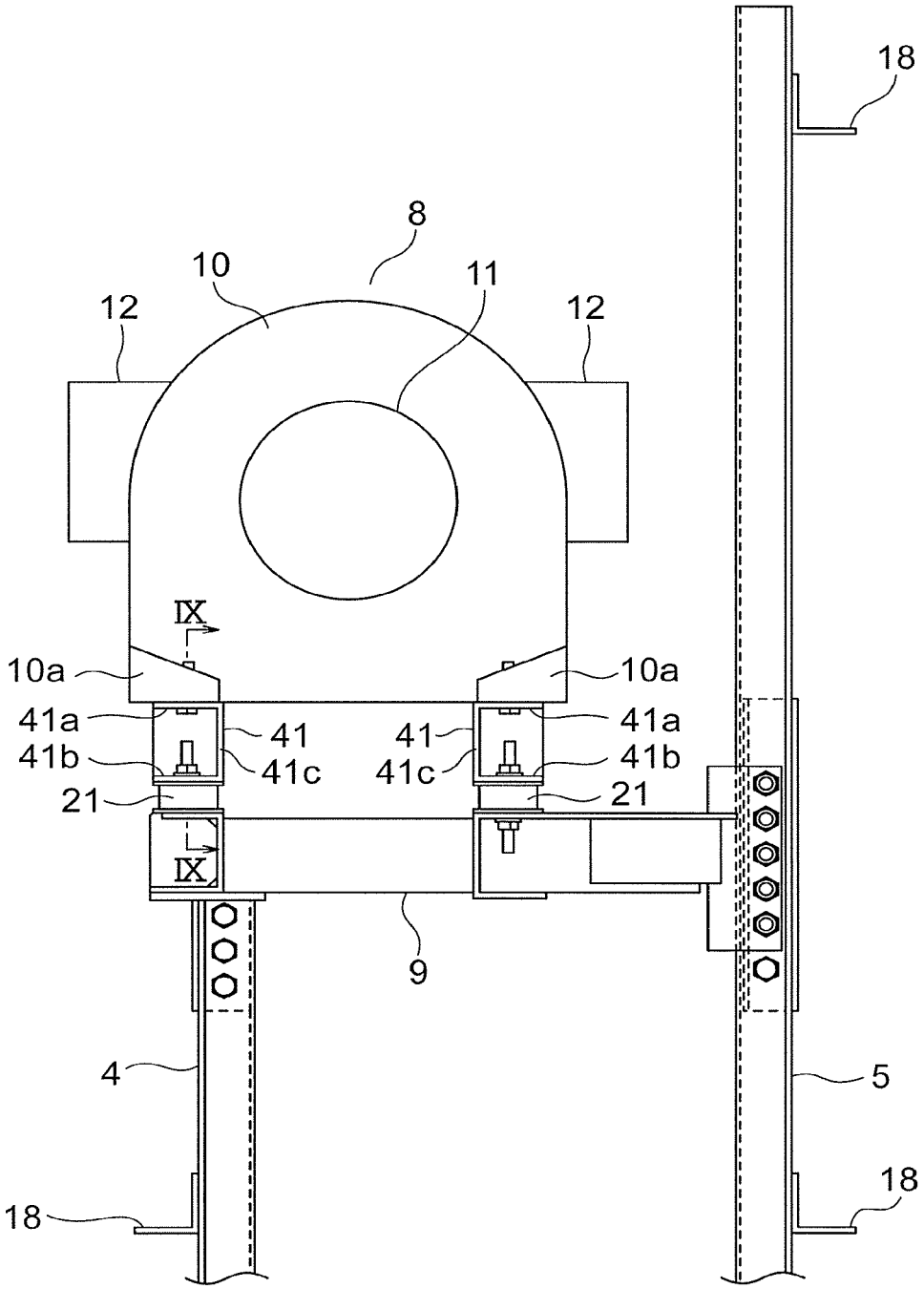
FIG. 8 is a front view showing a condition in which an elevator hoisting machine is mounted on a machine base, according to a third embodiment of this invention.
Figure 9:
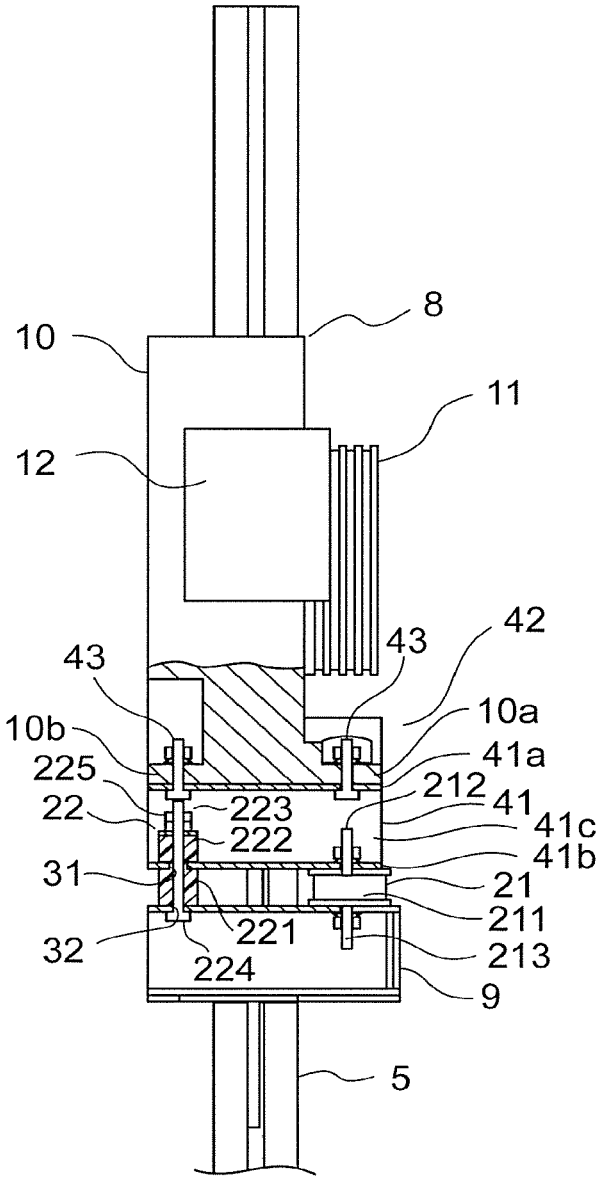
FIG. 9 is a sectional view taken along an IX-IX line in FIG. 8.

FIG. 8 is a front view showing a condition in which an elevator hoisting machine is mounted on a machine base, according to a third embodiment of this invention, and FIG. 9 is a side view showing a hoisting machine unit, including a partial cross-section taken along an IX-IX line in FIG. 8. A pair of elevating bases 41 that are lower in weight than the hoisting machine 8 are provided detachably on the lower portion of the hoisting machine 8. In this embodiment, a hoisting machine unit 42 is constituted by the hoisting machine 8 and the pair of elevating bases 41.

The pair of elevating bases 41 are disposed at a remove from each other in the horizontal direction when the hoisting machine 8 is seen in the axial direction of the drive sheave 11. Further, the elevating bases 41 are disposed so as to extend in the axial direction of the drive sheave 11. The hoisting machine 8 is placed on the pair of elastic support devices 21 via the elevating bases 41. The pair of buckling suppression devices 22 are attached to the elevating bases 41.

Each elevating base 41 includes an upper plate portion 41*a* disposed horizontally, a lower plate portion 41*b* disposed horizontally below the upper plate portion 41*a*, and a vertical plate portion 41*c* that connects the upper plate portion 41*a* to the lower plate portion 41*b*. The elevating base 41 is fixed to the lower portion of the hoisting machine main body 10 by fastening the upper plate portion 41*a* to the respective lower surfaces of the hoisting machine front leg portion 10*a* and the hoisting machine back leg portion 10*b*, provided on the hoisting machine main body 10, using a plurality of fastening tools 43.

A first lengthwise direction end portion of the lower plate portion 41*b* of the elevating base 41 serves as the supporting attachment portion that is placed on the elastic support device 21, and a second lengthwise direction end portion of the lower plate portion 41*b* of the elevating base 41 serves as the buckling suppression attachment portion to which the buckling suppression device 22 is attached. Accordingly, the upper portion projecting bolt 212 of the elastic support device 21 penetrates the first lengthwise direction end portion of the lower plate portion 41*b* of the elevating base 41 so as to be capable of sliding therethrough. Further, the second lengthwise direction end portion of the lower plate portion 41*b* of the elevating base 41 is sandwiched from above and below by the first and second buckling suppression rubber members 221, 222 of the buckling suppression device 22. Furthermore, the through hole 31 through which the through bolt 224 of the buckling suppression device 22 passes and the respective insertion portions 221*b*, 222*b* of the first and second buckling suppression rubber members 221, 222 are inserted is provided in the second lengthwise direction end portion of the lower plate portion 41*b* of the elevating base 41. All other configurations are identical to the first embodiment.

Next, a method of mounting the hoisting machine 8 in the hoistway 1 will be described. In a factory, the pair of elevating bases 41, to which the hoisting machine 8 is not attached, are attached in advance to the machine base 9 by the elastic support devices 21 and the buckling suppression devices 22. When the machine base 9 is shipped from the factory, the pair of elevating bases 41, to which the hoisting machine 8 is not attached, are attached to the machine base 9.

Figure 10:
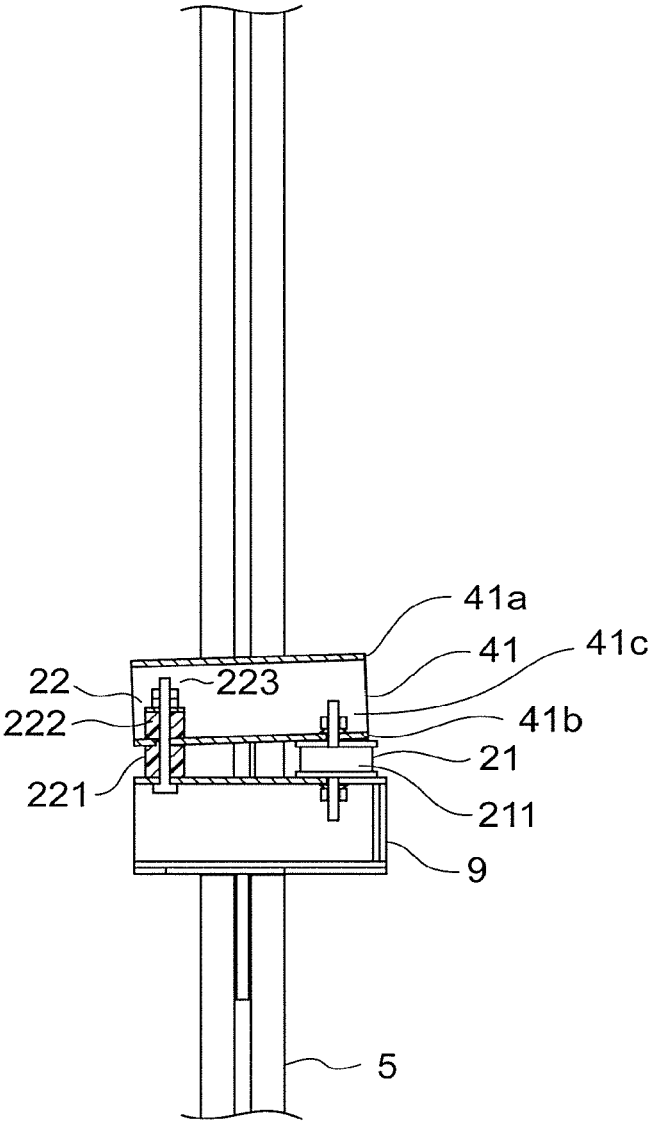
FIG. 10 is a partial sectional view showing a condition in which the machine base is mounted in a hoistway 1 before mounting the hoisting machine shown in FIG. 9 in the hoistway.
Figure 11:
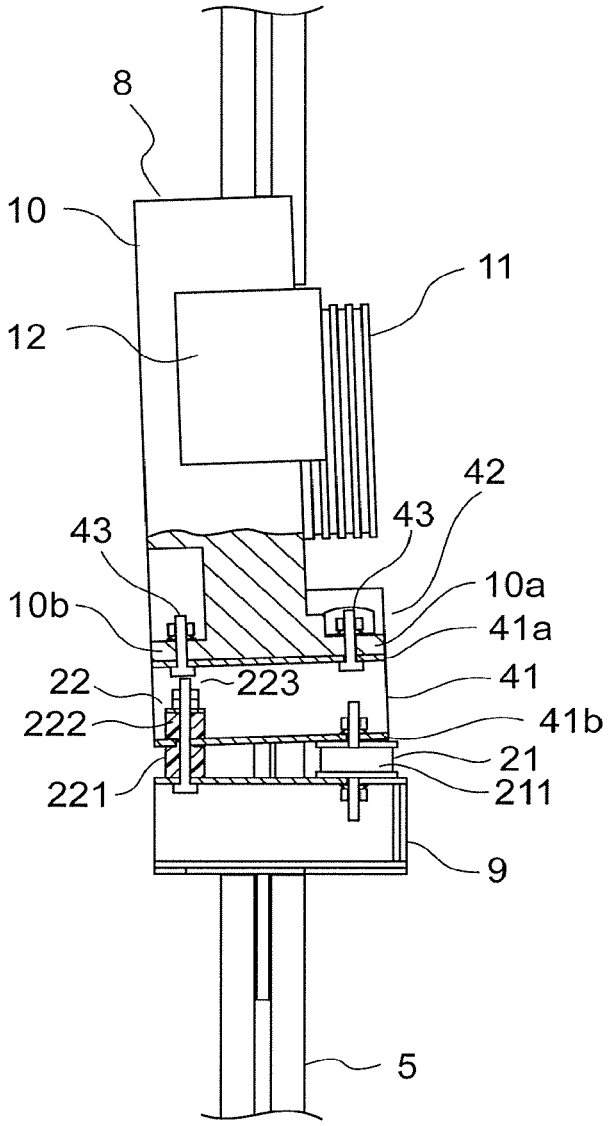
FIG. 11 is a partial sectional view showing a condition in which the hoisting machine is attached to an elevating base shown in FIG. 10.

FIG. 10 is a partial sectional view showing a condition in which the machine base 9 is mounted in the hoistway 1 before mounting the hoisting machine 8 shown in FIG. 9 in the hoistway 1. Further, FIG. 11 is a partial sectional view showing a condition in which the hoisting machine 8 is attached to the elevating base 41 shown in FIG. 10. Furthermore, FIG. 12 is a partial sectional view showing a condition in which loads from the car 6 and the counter weight 7 are exerted downward on the drive sheave 11 of the hoisting machine 8 shown in FIG. 11.

To mount the machine base 9 in the hoistway 1, the machine base 9 is attached to the car guide rail 2 and the counter weight guide rails 4, 5 with the pair of elevating bases 41 attached to the machine base 9. At this time, as shown in FIG. 10, the upper surface of the machine base 9 is oriented horizontally, while the elevating bases 41 are tilted relative to the machine base 9 so that a distance between the lower surface of each elevating base 41 and the upper surface of the machine base 9 increases steadily from the position of the buckling suppression device 22 to the position of the elastic support device 21. A tilt angle of the elevating base 41 relative to the machine base 9 is adjusted by adjusting an amount by which the nut 225 is fastened to the through bolt 224 while the hoisting machine 8 remains unattached to the respective elevating bases 41. The tilt angle of the elevating base 41 relative to the machine base 9 may be adjusted in the factory before the machine base 9 is shipped.

Next, as shown in FIG. 11, the hoisting machine 8 is fixed to the upper plate portions 41*a* of the elevating bases 41 by the plurality of fastening tools 43. At this time, the hoisting machine 8 is tilted relative to the machine base 9 such that the drive sheave 11 is oriented diagonally upward.

Figure 12:
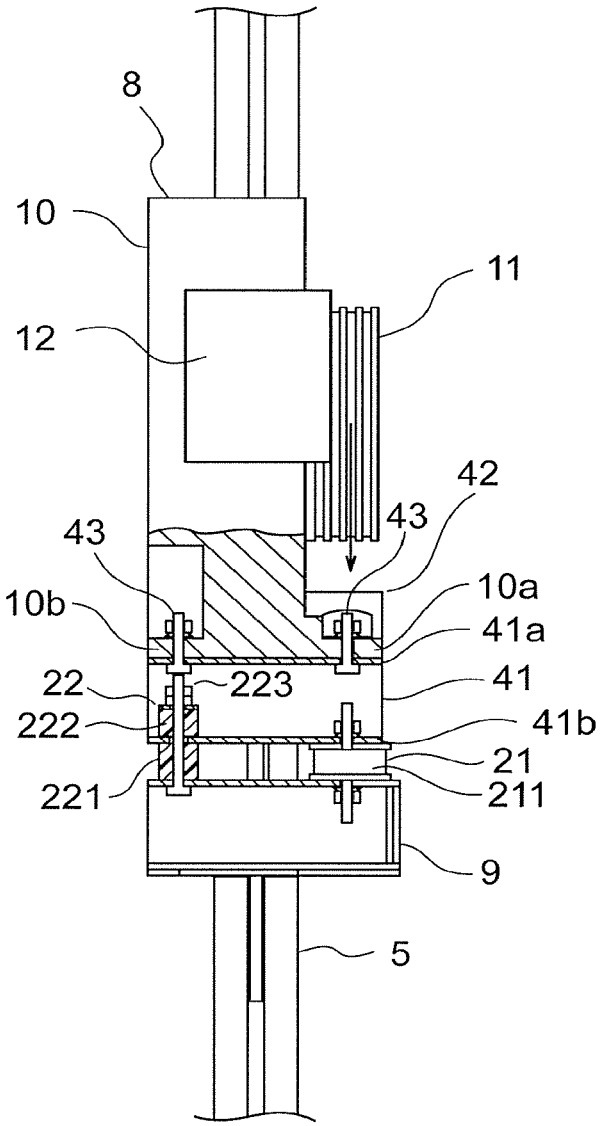
FIG. 12 is a partial sectional view showing a condition in which loads from a car and a counter weight are exerted downward on a drive sheave of the hoisting machine shown in FIG. 11.

Next, as shown in FIG. 12, the ropes 13 are wound around the drive sheave 11 such that the loads from the car 6 and the counter weight 7 are exerted on the drive sheave 11, and as a result, the supporting rubber members 211 of the respective elastic support devices 21 deform elastically so as to be compressed. Accordingly, the front end portion of the hoisting machine 8 is displaced downward using the buckling suppression devices 22 as a fulcrum such that the axis of the drive sheave 11 becomes horizontal. Thus, the hoisting machine 8 is mounted in the hoistway 1.

In this elevator hoisting machine mounting device, the hoisting machine 8 is placed on the elastic support devices 21 via the elevating bases 41, and the buckling suppression devices 22 are attached to the lower plate portions 41*b* of the respective elevating bases 41. Accordingly, the elastic support devices 21 and the buckling suppression devices 22 can be attached to the machine base 9 together with the elevating bases 41 in advance before mounting the machine base 9 in the hoistway 1. Further, by tilting the elevating bases 41 relative to the machine base 9 in advance, adjustments required to mount the hoisting machine 8 so that the axis of the drive sheave 11 is horizontal can be performed in advance. As a result, an operation to mount the hoisting machine 8 can be performed more easily.

Note that in the example described above, the elevating bases 41 are applied to a hoisting machine unit that includes the hoisting machine 8 according to the first embodiment, but the elevating bases 41 may be applied to a hoisting machine unit that includes the hoisting machine 8 according to the second embodiment. In this case, an elevating base to which the buckling suppression device 22 has been attached is attached to the lower portion of the hoisting machine main body 10 separately to the pair of elevating bases 41 so as to be disposed between the pair of elevating bases 41 when the hoisting machine 8 is seen in the axial direction of the drive sheave 11.

Fourth Embodiment

Figure 13:
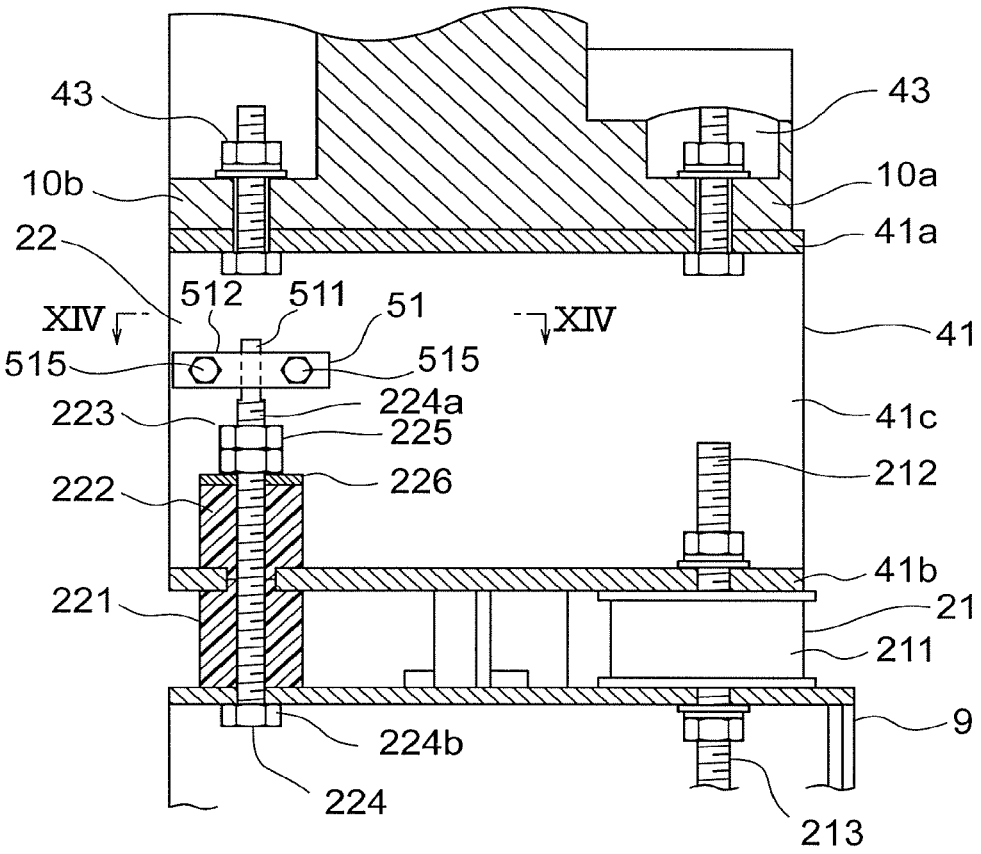
FIG. 13 is a sectional view showing main parts of an elevator hoisting machine mounting device according to a fourth embodiment.
Figure 14:
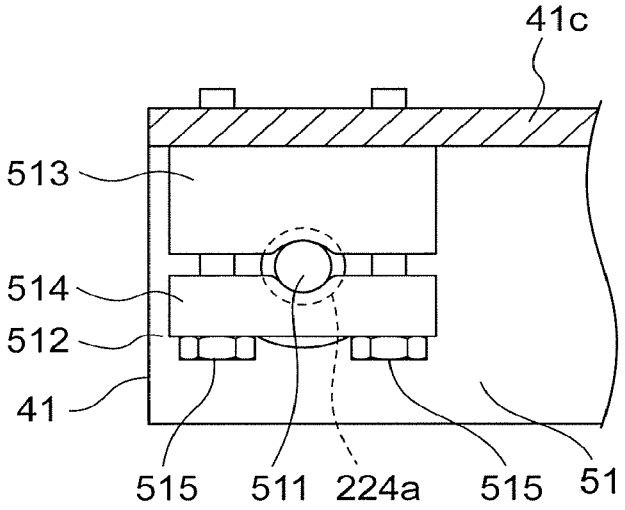
FIG. 14 is a sectional view taken along an XIV-XIV line in FIG. 13.

FIG. 13 is a sectional view showing main parts of an elevator hoisting machine mounting device according to a fourth embodiment, and FIG. 14 is a sectional view taken along an XIV-XIV line in FIG. 13. Each buckling suppression device 22 further includes a brake mechanism portion 51 that applies a brake to vertical direction displacement of the through bolt 224 relative to the hoisting machine unit 42.

The brake mechanism portion 51 includes a rod-shaped sliding portion 511 that projects upward from the upper end portion of the through bolt 224, and a gripping portion 512 that is attached to the elevating base 41 so as to grip the sliding portion 511.

A length of the sliding portion 511 is set so that the gripping portion 512 is not detached from the sliding portion 511 by displacement of the elevating base 41 relative to the through bolt 224. In this example, an outer diameter of the sliding portion 511 is set to be smaller than an outer diameter of the screw shaft portion 224*a* of the through bolt 224.

As shown in FIG. 14, the gripping portion 512 includes first and second shoes 513, 514 serving as a pair of braking members that sandwich the sliding portion 511, and adjustment bolts 515 serving as adjustment tools for adjusting a pressing force by which the first and second shoes 513, 514 press the sliding portion 511 from either side. In this example, the first shoe 513 is disposed between the vertical plate portion 41*c* of the elevating base 41 and the sliding portion 511, and the second shoe 514 is disposed on the opposite side of the sliding portion 511 to the first shoe 513.

The gripping portion 512 is attached to the elevating base 41 by attaching the adjustment bolts 515 penetrating the first and second shoes 513, 514 to screw holes, not shown in the drawing, provided in the vertical plate portion 41*c* of the elevating base 41. Further, the pressing force exerted on the sliding portion 511 by the first and second shoes 513, 514 is adjusted by adjusting an amount by which the adjustment bolts 515 are fastened.

Frictional force is generated between the sliding portion 511 and each of the first and second shoes 513, 514. The frictional force generated between the sliding portion 511 and the first and second shoes 513, 514 applies a brake to the vertical direction displacement of the through bolt 224 relative to the elevating base 41. In other words, the brake mechanism portion 51 functions as a friction damper. Accordingly, when the brake mechanism portion 51 applies a brake to displacement of the through bolt 224 relative to the elevating base 41, oscillation of the hoisting machine unit 42 relative to the machine base 9 is suppressed. A magnitude of the frictional force generated between the sliding portion 511 and the first and second shoes 513, 514 is adjusted by adjusting the pressing force applied to the sliding portion 511 by the first and second shoes 513, 514. All other configurations are identical to the third embodiment.

In this elevator hoisting machine mounting device, the brake mechanism portion 51 applies a brake to the vertical direction displacement of the through bolt 224 relative to the elevating base 41, and therefore oscillation of the hoisting machine unit 42 relative to the machine base 9 can be suppressed more reliably.

Note that although the brake mechanism portion 51 functions as a friction damper in the example described above, the brake mechanism portion 51 is not limited thereto, and may function as an air damper or the like, for example.

Further, in the example described above, the brake mechanism portion 51 is applied to the hoisting machine unit 42 of the third embodiment, which includes the hoisting machine 8 and the elevating bases 41, but the brake mechanism portion 51 maybe applied to the hoisting machine unit of the first embodiment or the second embodiment, which includes only the hoisting machine 8. In this case, the brake mechanism portion 51 is provided on the hoisting machine main body 10.

Fifth Embodiment

Figure 15:
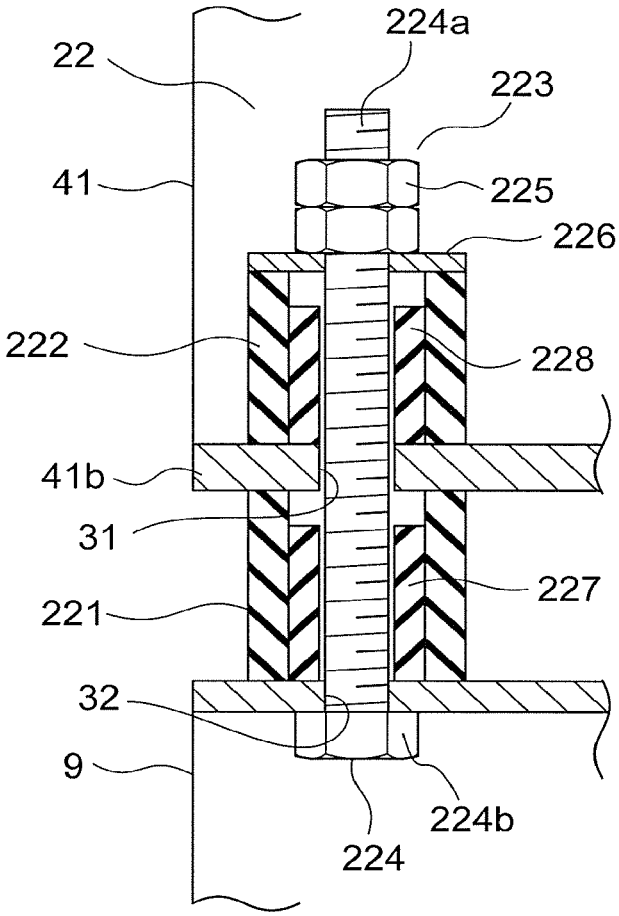
FIG. 15 is a sectional view showing main parts of an elevator hoisting machine mounting device according to a fifth embodiment.

FIG. 15 is a sectional view showing main parts of an elevator hoisting machine mounting device according to a fifth embodiment. Each buckling suppression device 22 includes the first and second buckling suppression rubber members 221, 222, which sandwich the second lengthwise direction end portion (in other words, the buckling suppression attachment portion) of the lower plate portion 41*b* of the elevating base 41 from above and below, the holding tool 223 that holds the first and second buckling suppression rubber members 221, 222 on the machine base 9, a first auxiliary rubber member 227 serving as a first auxiliary elastic body disposed on an inner side of the first buckling suppression rubber member 221, and a second auxiliary rubber member 228 serving as a second auxiliary elastic body disposed on an inner side of the second buckling suppression rubber member 222. The holding tool 223 is configured identically to that of the first embodiment.

The first and second buckling suppression rubber members 221, 222 are tubular rubber members. The first buckling suppression rubber member 221 is sandwiched between an upper surface of the support plate portion of the machine base 9 and a lower surface of the lower plate portion 41*b* of the elevating base 41. The second buckling suppression rubber member 222 is sandwiched between an upper surface of the lower plate portion 41*b* of the elevating base 41 and a lower surface of the washer 226.

The first and second auxiliary rubber members 227, 228 are tubular rubber members having outer diameters that are smaller than respective inner diameters of the first and second buckling suppression rubber members 221, 222. The first auxiliary rubber member 227 is disposed such that an outer peripheral surface thereof opposes an inner peripheral surface of the first buckling suppression rubber member 221. The second auxiliary rubber member 228 is disposed such that an outer peripheral surface thereof opposes an inner peripheral surface of the second buckling suppression rubber member 222. The screw shaft portion 224*a* of the through bolt 224 is passed slidably through the first and second auxiliary rubber members 227, 228.

A length of the first auxiliary rubber member 227 is set to be shorter than a length of the first buckling suppression rubber member 221 in an extension direction of the through bolt 224. Further, a length of the second auxiliary rubber member 228 is set to be shorter than a length of the second buckling suppression rubber member 222 in the extension direction of the through bolt 224.

A spring constant of the first auxiliary rubber member 227 differs from the spring constant of the first buckling suppression rubber member 221. Further, a spring constant of the second auxiliary rubber member 228 differs from the spring constant of the second buckling suppression rubber member 222. In this example, the spring constant of the first auxiliary rubber member 227 is larger than the spring constant of the first buckling suppression rubber member 221, and the spring constant of the second auxiliary rubber member 228 is larger than the spring constant of the second buckling suppression rubber member 222. All other configurations are identical to the third embodiment.

During a normal elevator operation, oscillation of the hoisting machine unit 42 and so on when the elevator is stopped and started, for example, is suppressed by the elastic restoring force of the first and second buckling suppression rubber members 221, 222. However, when a large external force caused by a braking operation of a safety device, an earthquake, or the like, for example, is exerted on the hoisting machine unit 42 such that the first buckling suppression rubber member 221 or the second buckling suppression rubber member 222 is compressed by a large amount, force is also exerted on the first auxiliary rubber member 227 or the second auxiliary rubber member 228. As a result, buckling of the hoisting machine unit 42 is suppressed by a combined elastic restoring force obtained by adding the elastic restoring force of the first auxiliary rubber member 227 or the second auxiliary rubber member 228 to the elastic restoring force of the first buckling suppression rubber member 221 or the second buckling suppression rubber member 222.

In this elevator hoisting machine mounting device, the first auxiliary rubber member 227, which is shorter than the first buckling suppression rubber member 221, is disposed on the inner side of the first buckling suppression rubber member 221, and the second auxiliary rubber member 228, which is shorter than the second buckling suppression rubber member 222, is disposed on the inner side of the second buckling suppression rubber member 222. Therefore, when the hoisting machine unit 42 oscillates by a large amount such that the first or second buckling suppression rubber member 221, 222 is greatly compressed, buckling of the hoisting machine unit 42 can be suppressed by the elastic restoring force of the first or second auxiliary rubber member 227, 228 in addition to the elastic restoring force of the first or second buckling suppression rubber member 221, 222. As a result, buckling of the hoisting machine unit 42 can be suppressed more reliably.

Further, the spring constant of the first auxiliary rubber member 227 is set to be larger than the spring constant of the first buckling suppression rubber member 221, and the spring constant of the second auxiliary rubber member 228 is set to be larger than the spring constant of the second buckling suppression rubber member 222. Therefore, an elastic restoring force that is larger than the elastic restoring force of the first and second buckling suppression rubber members 221, 222 can be generated by the first and second auxiliary rubber members 227, 228 in response to the amount of oscillation of the hoisting machine unit 42. As a result, buckling of the hoisting machine unit 42 can be suppressed even more reliably.

Note that in the example described above, the spring constant of the first auxiliary rubber member 227 is set to be larger than the spring constant of the first buckling suppression rubber member 221, but as long as a combined spring constant of the first buckling suppression rubber member 221 and the first auxiliary rubber member 227 is larger than the spring constant of the first buckling suppression rubber member 221 alone, the spring constant of the first auxiliary rubber member 227 may be identical to the spring constant of the first buckling suppression rubber member 221, or the spring constant of the first auxiliary rubber member 227 may be smaller than the spring constant of the first buckling suppression rubber member 221.

Further, in the example described above, the first auxiliary rubber member 227 is disposed on the inner side of the first buckling suppression rubber member 221, but the first auxiliary rubber member 227 may be disposed on an outer side of the first buckling suppression rubber member 221. In this case, an inner diameter of the first auxiliary rubber member 227 is set to be larger than an outer diameter of the first buckling suppression rubber member 221.

Furthermore, in the example described above, the second auxiliary rubber member 228 is disposed on the inner side of the second buckling suppression rubber member 222, but the second auxiliary rubber member 228 may be disposed on an outer side of the second buckling suppression rubber member 222. In this case, an inner diameter of the second auxiliary rubber member 228 is set to be larger than an outer diameter of the second buckling suppression rubber member 222.

Moreover, in the example described above, the first and second auxiliary rubber members 227, 228 are used as the first and second auxiliary elastic bodies, but the first and second auxiliary elastic bodies are not limited to being constituted by rubber, and at least one of the first and second auxiliary elastic bodies may be formed from a spring or the like, for example.

Furthermore, the first and second auxiliary rubber members 227, 228 may be applied to the buckling suppression device 22 of the first embodiment or the second embodiment. Moreover, the brake mechanism portion 51 the fourth embodiment may be applied to the buckling suppression device 22 of the fifth embodiment.

Further, in the embodiments described above, the supporting rubber member 211 is used as the supporting elastic body that deforms elastically upon reception of a load from the hoisting machine 8, but the supporting elastic body is not limited to being constituted by rubber, and may be formed from a spring or the like, for example.

Furthermore, in the embodiments described above, the first and second buckling suppression rubber members 221, 222 are used as the first and second buckling suppression elastic bodies, but the first and second buckling suppression elastic bodies are not limited to being constituted by rubber, and at least one of the first and second buckling suppression elastic bodies may be formed from a spring or the like, for example.

Moreover, in the embodiments described above, the through bolt 224 is simply passed through the through hole 32 in the support plate portion of the machine base 9 without being fixed to the machine base 9, but the through bolt 224 may, for example, be fixed to the machine base 9 by welding or the like, for example.

Furthermore, in the embodiments described above, the first and second buckling suppression rubber members 221, 222 are held on the machine base 9 by the holding tool 223 including the through bolt 224 and the nut 225, but the first and second buckling suppression rubber members 221, 222 are not limited to being held on the machine base 9 by this configuration. For example, the first and second buckling suppression rubber members 221, 222 may be held on the machine base 9 by fixing a holding tool, the holding tool having an upright portion that projects upward from the upper surface of the machine base 9 and a horizontal portion that projects horizontally from an upper end portion of the upright portion, to the machine base 9 on the outer sides of the first and second buckling suppression rubber members 221, 222 so that the first and second buckling suppression rubber members 221, 222 are sandwiched between the upper surface of the machine base 9 and the horizontal portion.

Furthermore, in the embodiments described above, two elastic support devices 21 are provided, but the number of elastic support devices 21 may be set at three or more. Moreover, in the first, third, fourth, and fifth embodiments, two buckling suppression devices 22 are provided, but the number of buckling suppression devices 22 may be set at three or more.

The invention claimed is:

1. An elevator hoisting machine mounting device comprising:

an elastic support device provided on a machine base, a hoisting machine unit having a hoisting machine that generates driving force for moving an elevating body being placed on the elastic support device; and a buckling suppression device disposed at a position separated from the elastic support device in a horizontal direction, wherein the elastic support device includes a supporting elastic body that deforms elastically upon reception of a load from the hoisting machine unit, the buckling suppression device includes a first buckling suppression elastic body arranged below a buckling suppression attachment portion provided on a lower portion of the hoisting machine unit, a second buckling suppression elastic body arranged above the buckling suppression attachment, and a holding tool that holds the first and second buckling suppression elastic bodies on the machine base, the first and second buckling suppression elastic bodies contacting each other within a hole in the buckling suppression attachment portion, whereby buckling of the hoisting machine unit relative to the machine base due to the elastic deformation of the supporting elastic body is suppressed by an elastic restoring force of the first and second buckling suppression elastic bodies, the hoisting machine includes a drive sheave where a load from the elevating body is exerted downward, and a position of the elastic support device is aligned with a position of the drive sheave in an axial direction of the drive sheave.

2. The elevator hoisting machine mounting device according to claim 1, wherein the hoisting machine unit further includes an elevating base provided detachably on a lower portion of the hoisting machine, the hoisting machine is placed on the elastic support device via the elevating base, and the elevating base includes the buckling suppression attachment portion.

3. The elevator hoisting machine mounting device according to claim 2, wherein the holding tool includes a rod-shaped body that projects from the machine base so as to penetrate the buckling suppression attachment portion and the first and second buckling suppression elastic bodies, and a fixing member that is provided on the rod-shaped body such that the buckling suppression attachment portion and the first and second buckling suppression elastic bodies are sandwiched together between the fixing member and the machine base.

4. The elevator hoisting machine mounting device according to claim 3, wherein the buckling suppression device further includes a brake mechanism portion that applies a brake to vertical direction displacement of the rod-shaped body relative to the hoisting machine unit.

5. The elevator hoisting machine mounting device according to claim 1, wherein the holding tool includes a rod-shaped body that projects from the machine base so as to penetrate the buckling suppression attachment portion and the first and second buckling suppression elastic bodies, and a fixing member that is provided on the rod-shaped body such that the buckling suppression attachment portion and the first and second buckling suppression elastic bodies are sandwiched together between the fixing member and the machine base.

6. The elevator hoisting machine mounting device according to claim 5, wherein the buckling suppression device further includes a brake mechanism portion that applies a brake to vertical direction displacement of the rod-shaped body relative to the hoisting machine unit.

7. The elevator hoisting machine mounting device according to claim 1, further comprising:

at least one additional buckling suppression device, wherein a downward load is exerted by the elevating body on the drive sheave, and the buckling suppression device and the at least one additional buckling suppression device are disposed in positions further away from the drive sheave than the elastic support device in an axial direction of the drive sheave, and disposed at a position separated from each other when seen in the axial direction of the drive sheave.

8. The elevator hoisting machine mounting device according to claim 1, wherein the elastic support device is provided in a pair, the buckling suppression device is provided singly, the hoisting machine includes a drive sheave on which a downward load is exerted from the elevating body, the pair of elastic support devices are disposed at a remove from each other when seen in an axial direction of the drive sheave, and the single buckling suppression device is disposed in a position further away from the drive sheave than the respective elastic support devices in the axial direction of the drive sheave, and disposed between the pair of elastic support devices when seen in the axial direction of the drive sheave.

* * * * *